US008863854B2

(12) United States Patent
Jones et al.

(10) Patent No.: US 8,863,854 B2
(45) Date of Patent: Oct. 21, 2014

(54) METHOD AND APPARATUS FOR ISOLATING TUBING WITH A SWELLABLE SEAL

(71) Applicant: Weatherford/Lamb, Inc., Houston, TX (US)

(72) Inventors: Colin Jones, Aberdeen (GB); John Alasdair MacDonald Cameron, Houston, TX (US); Gary John Smart, Alford (GB); David S. Grant, Inverurie (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 13/724,849

(22) Filed: Dec. 21, 2012

(65) Prior Publication Data

US 2013/0180094 A1 Jul. 18, 2013

Related U.S. Application Data

(62) Division of application No. 12/341,531, filed on Dec. 22, 2008, now Pat. No. 8,336,618.

(30) Foreign Application Priority Data

Dec. 22, 2007 (GB) ..... 0725128.3

(51) Int. Cl.

| | |
|---|---|
| ***E21B 33/12*** | (2006.01) |
| ***E21B 43/10*** | (2006.01) |
| ***E21B 43/32*** | (2006.01) |
| ***E21B 43/08*** | (2006.01) |

(52) U.S. Cl.

CPC ..... *E21B 33/1208* (2013.01); *E21B 43/103* (2013.01); *E21B 43/32* (2013.01); *E21B 43/08* (2013.01); *Y10S 277/934* (2013.01)

USPC ..... 166/387; 166/207; 166/227; 277/934

(58) Field of Classification Search

USPC ..... 166/227, 207, 387; 277/331, 333, 338, 277/934

See application file for complete search history.

(56) References Cited

U.S. PATENT DOCUMENTS

| | | | |
|---|---|---|---|
| 3,219,113 | A | 11/1965 | Ward |
| 6,012,522 | A | 1/2000 | Donnelly et al. |

(Continued)

FOREIGN PATENT DOCUMENTS

| | | | |
|---|---|---|---|
| GB | 2421527 | A | 6/2006 |
| WO | 2004022911 | A2 | 3/2004 |

(Continued)

*Primary Examiner* — Brad Harcourt
*Assistant Examiner* — Catherine Loikith
(74) *Attorney, Agent, or Firm* — Patterson & Sheridan, LLP

(57) ABSTRACT

An apparatus for isolating at least a portion of a tubular for use in a wellbore comprising a first, inner tubular in the form of carrier tube and a second, outer tubular in the form of protective shroud, coupled to the carrier tube. One or more aperture is provided in a wall of the carrier tube for permitting fluid transfer through the tube and one or more aperture is provided to permit fluid transfer through the shroud. A sealing layer is disposed on a surface of the shroud, the sealing layer defining a first configuration permitting fluid flow through the apertures and, on exposure to a selected reactant, adopting a second configuration to restrict fluid flow through the apertures, the sealing layer adapted to return from the second configuration to the first configuration where concentration of the selected reactant falls below a selected threshold.

30 Claims, 9 Drawing Sheets

(56) References Cited

U.S. PATENT DOCUMENTS

| | | | |
|---|---|---|---|
| 6,457,533 | B1 | 10/2002 | Metcalfe |
| 6,672,385 | B2 | 1/2004 | Kilaas et al. |
| 6,834,725 | B2 | 12/2004 | Whanger et al. |
| 6,896,052 | B2 | 5/2005 | Simpson et al. |
| 6,948,716 | B2 | 9/2005 | Drouin |
| 6,976,542 | B2 | 12/2005 | Henriksen et al. |
| 7,059,415 | B2 | 6/2006 | Bosma et al. |
| 7,134,501 | B2 | 11/2006 | Johnson et al. |
| 8,011,438 | B2 | 9/2011 | Edwards et al. |
| 8,336,618 | B2 | 12/2012 | Jones et al. |
| 2003/0089503 | A1 | 5/2003 | Setterberg |
| 2004/0026313 | A1* | 2/2004 | Arlon Fischer ..... 210/484 |
| 2004/0118572 | A1 | 6/2004 | Whanger et al. |
| 2005/0173130 | A1 | 8/2005 | Richard |
| 2005/0252651 | A1 | 11/2005 | Bosma et al. |
| 2006/0175065 | A1 | 8/2006 | Ross |
| 2006/0185849 | A1 | 8/2006 | Edwards et al. |
| 2008/0283238 | A1 | 11/2008 | Richards et al. |

FOREIGN PATENT DOCUMENTS

| | | | |
|---|---|---|---|
| WO | 2006/003112 | A1 | 1/2006 |
| WO | 2007/094897 | A2 | 8/2007 |

* cited by examiner

METHOD AND APPARATUS FOR ISOLATING TUBING WITH A SWELLABLE SEAL

CROSS-REFERENCE TO RELATED APPLICATIONS

This application is a divisional of co-pending U.S. patent application Ser. No. 12/341,531, filed Dec. 22, 2008, which claims benefit of British patent application number 0725128.3, filed Dec. 22, 2007, which is herein incorporated by reference.

BACKGROUND OF THE INVENTION

1. Field of the Invention

This invention relates to a method and apparatus for isolating at least a portion of a tubular. In addition, this invention relates to a method for producing an apparatus for isolating at least a portion of a tubular.

2. Description of the Related Art

In the oil and gas industry, it is generally known that, in addition to hydrocarbons, an underground formation may include a relatively high percentage of water. Typically, where water is present this will underlie the hydrocarbons within the formation.

In reference to FIG. 1 of the drawings, a lower section 10 of a borehole 12 is shown extending from surface (not shown) towards an underground formation 14. The formation 14 comprises both a hydrocarbon reservoir 16 and a region containing water 18, the water 18 shown underlying the hydrocarbon reservoir 16. A well 20 may be completed to a level adjacent the hydrocarbon/water interface within the formation 14 by running a first tubular section, or casing (not shown), into the borehole 12 and supplying cement to the annulus around the tubing section to seal and secure the casing within the borehole 12. The borehole 12 is then extended and a second tubing section, or liner, is run into the borehole 12 and cemented in place, the liner supported by the casing above. The liner 15 adjacent the formation is then perforated to permit hydrocarbons from the reservoir 16 to be extracted to surface.

However, over time and due to the generally higher mobility of the water 18 within the formation 14, for example where relatively viscous hydrocarbons are present, water 18 is drawn towards the base 22 of the well 20 (as shown in FIG. 1 by the dotted lines 24, 26) until water is produced from the well 20. This phenomenon is known as "coning" and may be particularly prevalent in horizontal or deviated wells as water is drawn to the heel of the well, that is, where the well deviates from vertical.

It will be recognised that where water production occurs at the expense of production of hydrocarbons from the well, the recovery efficiency of the well will be adversely affected. The efficiency and utility of a well may be greatly reduced where a high percentage of water is produced from a well and, indeed, in some environments, it is known for a well to produce in excess of 50% water with water production approaching 100% in some areas of the well, while other areas may produce 100% hydrocarbons.

Typically, when water production is identified downhole, it is desired that the water producing zones are isolated in order to prevent this undesirable ingress of water.

For example, isolation may be achieved, for example, by setting mechanical packers across the water producing zone.

In U.S. Pat. No. 7,059,415, which is incorporated herein in its entirety by way of reference, when water production has been observed, a patch is run into the tubular and expanded into contact with the inner wall of the tubular to shut off water production from the respective zone. However, many current approaches may only be adopted after water production has been identified and typically require significant intervention into the well.

Alternatively, International Patent Application WO2004/0022911, which is incorporated herein in its entirety by way of reference, discloses a wellbore device comprising a tubular conduit comprising circular perforations. The device further comprises a swelling elastomer sleeve located about an exterior surface of the conduit. The generally perforations may be closed when the swelling elastomer encounters formation water to prevent inflow of water into the tubular.

As a further alternative, chemical agents may be pumped into the well to shut off unwanted water production. However, where chemical agents are used, it has been found that there are difficulties in targeting the chemicals to the desired location with a high degree of accuracy.

SUMMARY OF THE INVENTION

According to a first aspect of the present invention there is provided an apparatus for isolating at least a portion of a tubular for use in a wellbore, the apparatus comprising:

a tubular comprising at least one aperture in a wall of the tubular for permitting transfer of fluid through the aperture; and a seal member operatively associated with the tubular, the seal member defining a first configuration permitting fluid flow through the aperture and, on exposure to a selected reactant, adopting a second configuration to restrict fluid flow through the aperture, the seal member adapted to return from the second configuration to the first configuration where concentration of the selected reactant falls below a selected threshold.

The present invention thus provides an apparatus adapted to permit a desired fluid, for example, but not exclusively, production fluid, to enter the tubular and which is adapted to close in response to exposure to a selected reactant, for example formation water or the like. The present invention may obviate or mitigate the requirement for intervention into the well as the apparatus will react autonomously to the selected reactant to seal off the tubular in the affected region.

The seal member may be adapted to remain in the first configuration where ingress of the selected reactant is less than the selected threshold. Furthermore, the seal member may be adapted to adopt the second configuration where the ingress of the selected reactant equals or exceeds the selected threshold.

The threshold may be selected prior to location of the apparatus in the wellbore.

While generally undesirable, the properties of the formation and/or economic factors may dictate that a degree of water production may be permitted. Thus, the selected threshold may be carefully selected depending on the well conditions and the permissible ingress of the selected reactant. This may be achieved by appropriate selection of the blend or composition of the seal member. Thus, the seal member may return to the first configuration to permit ingress of fluid into the tubular, which fluid may then be transported to surface. Where a part of the tubular is isolated, the reactant may retreat from the tubular, for example the hydrocarbon/water interface may fall or drop back from the tubular. Thus, the seal member may revert to the first configuration once more to permit the isolated zone or zones of the tubular to once more permit transfer of fluid through the tubular when no longer exposed to unacceptable levels of the selected reactant.

The tubular may comprise an expandable tubular. The tubular may be adapted for expansion by any suitable means. For example, but not exclusively, the tubular may be adapted for expansion by a rotary expansion tool, such as that described in International Patent Application WO00/37766, which is incorporated herein in its entirety by way of reference. Alternatively, or in addition, other suitable expansion tools/techniques may be utilised. For example, swage expansion, the use of one or more inflatable members, bladders and the like are also contemplated.

The tubular may comprise slotted tubing, the aperture defining at least one elongate, longitudinal slot. For example, but not exclusively, the tubular may comprise a section of production tubing, carrier tube or the like. The tubular may typically comprise metal tubing, for example, but not exclusively, stainless steel though other suitable material may be used, where appropriate.

The apparatus may further comprise a filter screen layer. For example, the filter screen layer may comprise a sand screen, for example, but not exclusively, an expandable sand screen such as Applicant's ESS®. Thus, entrained particulate matter, such as sand particles, may be prevented or inhibited from passing into the tubular by the filter screen layer.

The filter screen layer may be adapted for location externally of the tubular.

The apparatus may further comprise a second tubular, the second tubular comprising an outer tubular, protective shroud or the like. Beneficially, the second tubular may provide protection for the filter screen layer.

The second tubular may comprise at least one aperture adapted to permit fluid ingress through the second tubular aperture. The at least one seal member aperture may be adapted for radial alignment with the at least one aperture of the second tubular. Thus, the at least one seal member aperture may be adapted to permit ingress of production fluid through the second tubular aperture.

The second tubular may comprise expandable tubing and the apparatus may be configured such that expansion of the tubular also expands the second tubular.

The second tubular may comprise slotted tubing, the at least one second tubular aperture defining at least one elongate, longitudinal slot.

The second tubular may be adapted for radial expansion substantially into contact with the wellbore. When used in combination with a rotary expansion tool or other variable diameter expansion tool, the use of a slotted tubular facilitates substantially full compliance of the second tubular with the wall of the wellbore. This is advantageous where it is necessary or desirable to isolate a section of the tubular in, for example, a rugose wellbore, where the wellbore has been subject to deformation or collapse, or in another condition resulting in a bore with a non-uniform cross-section. Substantially fully compliant expansion of the apparatus may permit the largest possible inner diameter of tubing to be achieved which may assist in increasing production from the formation. Also, it is considered that a larger inner diameter results in a relatively even fluid inflow profile from the formation which may assist in inhibiting ingress of the selected reactant.

The seal member may be adapted for location on an interior surface of the second tubular. It will be recognised that the seal member may be subject to wear or damage in the wellbore, in particular, during location of the apparatus in the wellbore. Location of the seal member within the second tubular may assist in protecting the seal member. This may be particularly advantageous where the tubular undergoes relatively low levels of expansion.

Alternatively, the seal member may be adapted for location on an exterior surface of the second tubular.

The seal member may be bonded to the second tubular. For example, but not exclusively, the seal member may be vulcanised onto the interior or exterior surface of the second tubular.

The seal member may comprise an elastomeric seal member. Furthermore, the seal member may comprise a swelling elastomer. On exceeding the selected threshold, the seal member will swell to isolate the affected zone of the tubular. For example, the selected threshold may relate to the concentration of water production from the formation. Alternatively, or in addition, the selected threshold may relate to any other variable such as temperature and/or time. For example, the tool may be adapted to move from the first configuration to the second configuration where a selected level of water production is observed for a selected time period.

The seal member may thus be adapted to swell to close the aperture. For example, the seal member may be adapted to swell by up to approximately 200% of the seal member original volume on exposure to the selected reactant. The seal member may be adapted to swell circumferentially and axially to a pre-determined extent. Thus, the swelling of the seal member may be controlled and/or contained, where necessary.

The filter screen layer may be adapted for location between the tubular and the second tubular. Furthermore, the filter screen layer may be adapted for location between the tubular and the seal member. The filter screen layer may comprise a plurality of filter sheets, for example, but not exclusively, the filter screen layer may comprise a plurality of overlapping filter sheets adapted for location on the tubular. Each filter sheet may be coupled at one edge to the tubular.

The apparatus may further comprise a friction reducing layer. The friction reducing layer may be provided to facilitate relative movement of the filter sheets relative to one another. The friction reducing layer may also facilitate relative movement of the filter layer and the seal member, for example, where the seal member is provided internally of the second tubular. The friction reducing layer may comprise a low friction coating applied to a least one of the filter sheets and/or the seal member.

Alternatively, or in addition, the apparatus may further comprise an alignment tool, for example, a centraliser tool or the like. The provision of a centraliser tool may assist in facilitating location of the apparatus in the wellbore and assist in providing protection to the seal member, in particular where the seal member is provided externally of the second tubular.

It will be readily recognised that more than one tubular may be provided. For example, but not exclusively, a number of tubulars may be provided end to end to form a tubing string. Each tubular may be coupled to the adjacent tubular by any suitable means known to a person skilled in the art.

The apparatus may further comprise a further tubular, sub or the like, the centraliser tool being formed in or provided on the further tubular. The further tubular may be adapted for coupling to the tubular or, where a number of tubulars are provided, between tubulars. The further tubular may or may not be subject to expansion.

The reactant may comprise a reactant fluid, for example, the reactant fluid may comprise formation water. Thus, the apparatus may be adapted to prevent water production from the well by reacting with water to isolate the tubular.

According to a second aspect of the present invention, there is provided a method for isolating at least a portion of a tubular for use in a wellbore, the method comprising:

providing a tubular comprising at least one aperture in a wall of the tubular for permitting transfer of fluid through the aperture; and providing a seal member operatively associated with the tubular, the seal member defining a first configuration permitting fluid flow through the aperture and on exposure to a selected reactant adopting a second configuration to restrict fluid flow through the aperture, the seal member adapted to move from the second configuration to the first configuration where concentration of the selected reactant falls below a selected threshold.

The method may further comprise locating the tubular downhole. The method may further comprise selecting the threshold prior to location of the apparatus in the wellbore. Thus, in use, when located downhole, the seal member will react autonomously to restrict fluid flow through the aperture without the requirement for intervention into the well.

The method may further comprise radially expanding the tubular. For example, but not exclusively, the tubular may be expanded by a rotary expansion tool.

The method may further comprise providing a filter screen layer, for example a sand screen or the like. The filter screen may be located between the tubular and the seal member and expansion of the tubular may also expand the filter screen layer. As noted hereinabove, the provision of a filter screen layer assists in preventing the ingress of particulate matter such as sand into the tubular.

The method may further comprise providing a second tubular, for example, an outer shroud or the like. Furthermore, the second tubular may comprise at least one aperture and, for example, may comprise slotted tubing.

Expanding the first tubular may also expand the second tubular such that the second tubular substantially engages the wall of the borehole.

While tubing comprising generally circular apertures may be used, it has been found that the use of slotted tubing advantageously permits substantially full compliance between the second tubular and the borehole wall. As noted hereinabove, substantially fully compliant expansion may permit the largest possible inner diameter of tubing to be achieved which may assist in increasing production from the formation.

According to a further aspect of the present invention, there is provided a method for producing an apparatus for isolating at least a portion of a tubular, the method comprising the steps:

providing a first member in the form of a tubular having at least one aperture in a wall of the tubular for permitting transfer of fluid through the aperture;

providing a second member comprising a structural layer and a seal layer;

creating at least one aperture in the second; and locating the second member around the tubular.

The method may further comprise creating the aperture in the structural layer and seal layer simultaneously, for example, but not exclusively, by a punching process or other suitable process. Thus, apertures which may be created in the seal layer and the structural layer will be substantially aligned. This obviates the requirement for separate alignment of the layers and advantageously reduces the manufacturing time and improves accuracy of alignment. The aperture may define an elongate longitudinal slot. Though the provision of a longitudinal slot may be preferred, it will be recognised that any suitable aperture may be utilised.

The method may further comprise forming the second member such that the seal layer is provided on an exterior surface of the second member. Where the sealing layer is provided on the outer surface of the second member, an alignment tool such a centraliser may be provided, the alignment tool assisting in protecting the seal layer from, for example, abrasion with a well bore wall.

Alternatively, the method may further comprise forming the second member such that the seal layer is provided on an interior surface of the second member. Thus, the method of the present invention permits location of the seal layer on the interior or exterior of the second member.

The method may further comprise providing the structural layer in sheet form and coupling a first end of the sheet to a second, opposite end of the sheet to create a tubular. For example, but not exclusively, the first end may be configured to abut the second end. Alternatively, the first end may be configured to overlap the second end. The method may further comprise the step of welding the first and second ends together to form the tubular, for example, but not exclusively, by laser welding, or the like.

The method may further comprise providing a filter screen layer coupled to the tubular. The filter screen layer may comprise a plurality of filter sheets coupled to the tubular. The method may further comprise coupling the filter sheets in an overlapping configuration. The method may further comprise coupling the filter sheets to the tubular such that on expansion of the tubular, the filter sheets remain overlapped.

According to a further aspect of the present invention there is provided an apparatus for isolating at least a portion of a tubular for use in a wellbore, the apparatus comprising:

a first, inner tubular and a second, outer tubular; and a seal member for coupling to the second tubular, the seal member defining a first configuration permitting fluid flow through the slot and on exposure to a selected reactant adopting a second configuration to restrict fluid flow through the slot.

According to a further aspect of the present invention there is provided a method for isolating at least a portion of a tubular for use in a wellbore, the apparatus comprising:

providing a tubular comprising at least one longitudinal slot in a wall of the tubular for permitting transfer of fluid through the slot; and providing a seal member operatively associated with the tubular, the seal member defining a first configuration permitting fluid flow through the aperture and on exposure to a selected reactant adopting a second configuration to restrict fluid flow through the aperture.

BRIEF DESCRIPTION OF THE DRAWINGS

These and other aspects of the present invention will now be described, by way of example, with reference to the accompanying drawings, in which.

DETAILED DESCRIPTION

Figure 1:
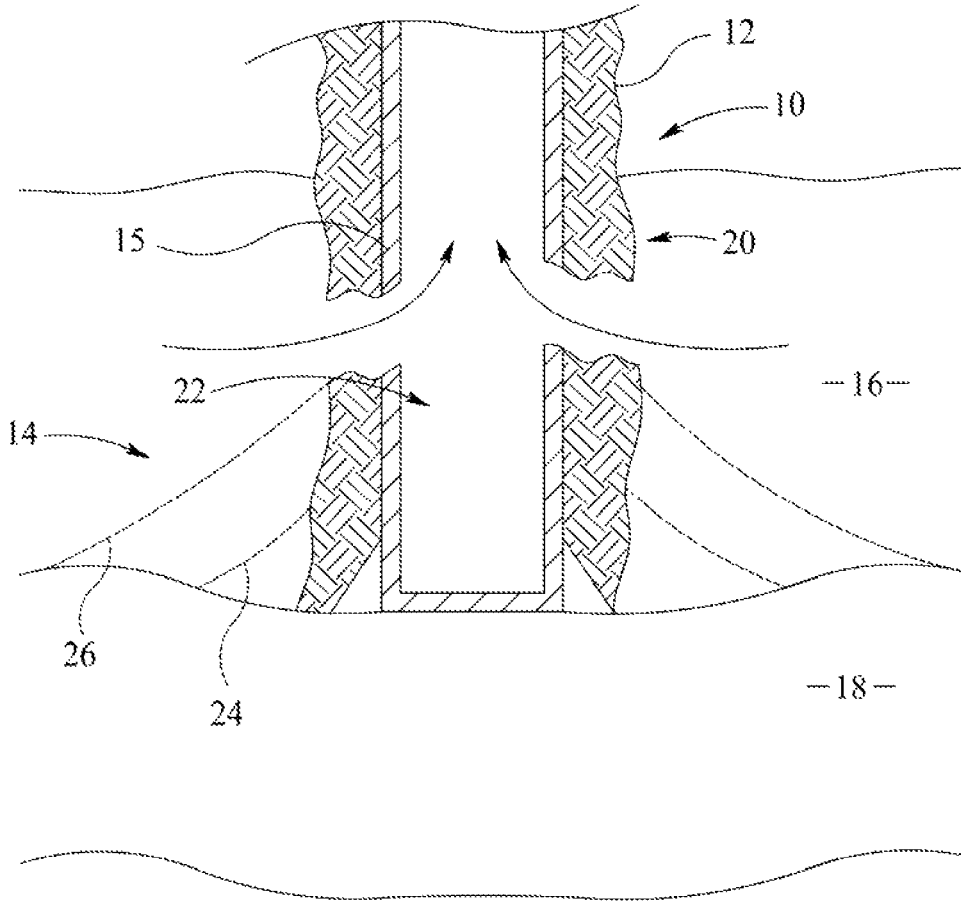
FIG. 1 (PRIOR ART)
FIG. 1 is a diagrammatic representation of a borehole extending from surface towards a hydrocarbon bearing formation, the formation comprising oil producing regions and water producing regions.
Figure 2:
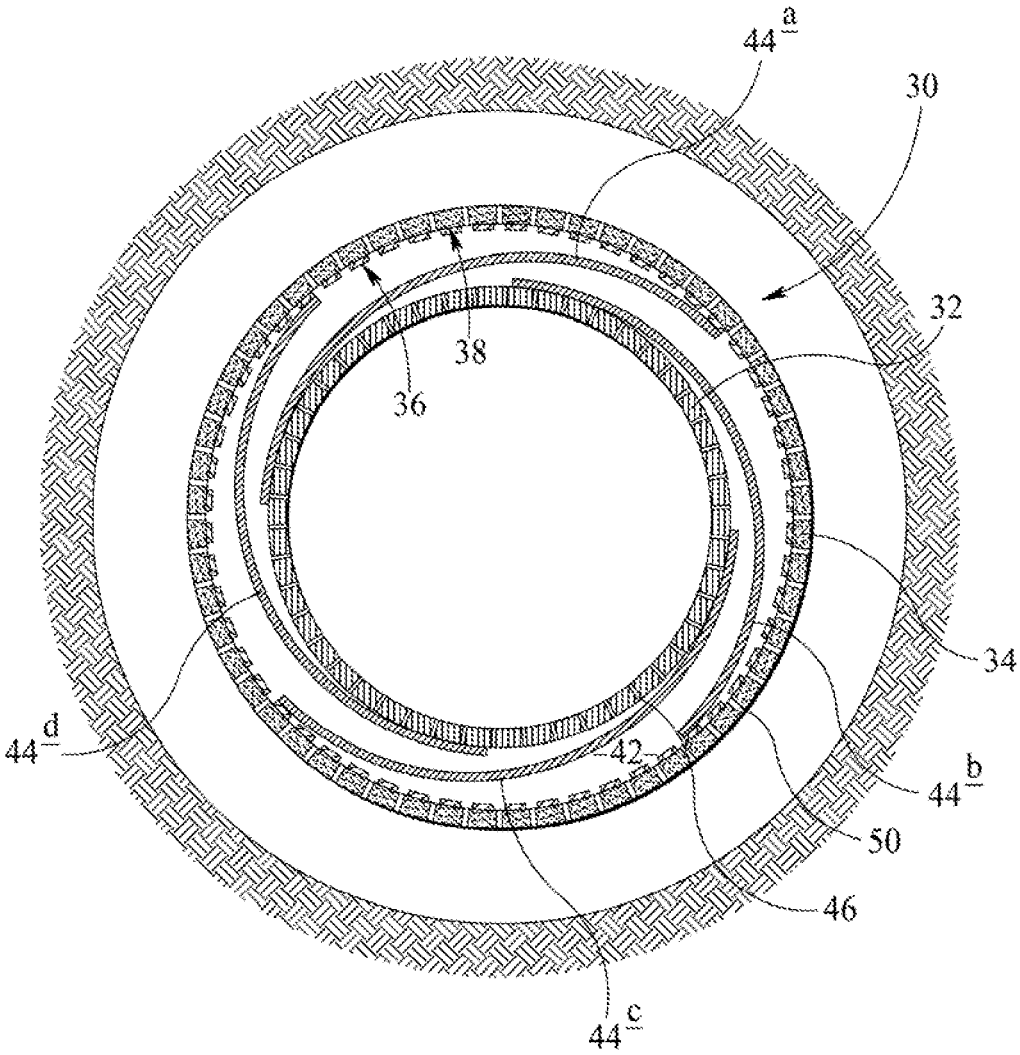
FIG. 2 is a cross sectional view of an apparatus for isolating at least a portion of a tubular in accordance with an embodiment of the present invention, shown in an unexpanded configuration.

Referring initially to FIG. 2 of the drawings, there is shown an apparatus 30 for isolating at least a portion of a tubular in accordance with a first embodiment of the present invention, the apparatus 30 shown in a first, unexpanded configuration.

The apparatus 30 comprises a first, inner tubular in the form of carrier tube 32 and a second, outer tubular in the form of protective shroud 34, coupled to the carrier tube 32. A seal member in the form of a sealing layer 36, is disposed on an inner surface 38 of the shroud 34. It will be recognised that the spacing between the carrier tube 32 and shroud 34 has been exaggerated for clarity.

The apparatus 30 further comprises a filter screen layer or screen 42 comprising meshed filter sheets 44*a*, 44*b*, 44*c*, and 44*d*, the filter sheets 44*a*, 44*b*, 44*c*, and 44*d* disposed between the carrier tube 32 and the shroud 34. Each of the filter sheets 44*a*, 44*b*, 44*c*, and 44*d* is mounted around the periphery of the carrier tube 32 such that each filter sheet 44*a*, 44*b*, 44*c*, and 44*d* overlaps the adjacent, neighbouring filter sheet. The filter sheets 44*a*, 44*b*, 44*c*, and 44*d* are constructed from a woven wire mesh and are spot welded to the carrier tube 32.

The sealing member 36 comprises a water swelling elastomer which is vulcanised onto the surface 38 of the shroud 34. When the sealing member 36 encounters formation water, the swelling elastomer will swell on that part of the shroud 34 to restrict the flow of the water through the shroud 34. In particular, the composition and/or blend of the swelling elastomer is selected such that the sealing member will seal the shroud apertures on equalling or exceeding a selected threshold of water production, typically defined in terms of a percentage water cut. For example, the sealing member 36 may be adapted to seal the shroud aperture at 50% water cut, though any other threshold may be selected as desired.

The restriction in flow may be targeted at the specific locations in which water production is expected or found to be present. The change in pressure caused by the restriction will modify the production profile and will be detectable at surface.

The carrier tube 32 comprises a plurality of longitudinally extending slots 46, the carrier tube 32 being expandable such that, in use, the slots 46 define a rhomboid or diamond shape 48.

Figure 3:
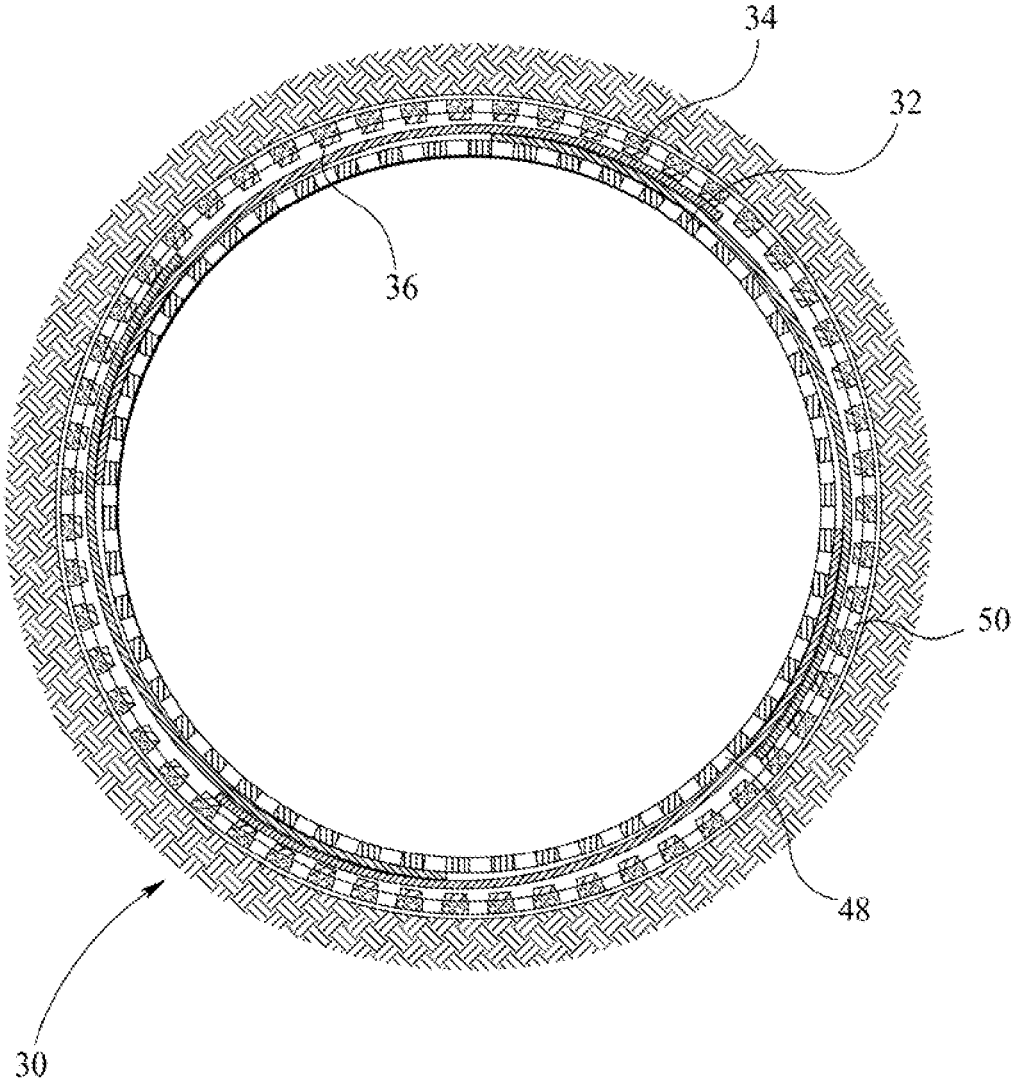
FIG. 3 is a cross sectional view of the apparatus of FIG. 2, shown in an expanded configuration and seal member in a first configuration in accordance to one embodiment of the invention.
Figure 3A:
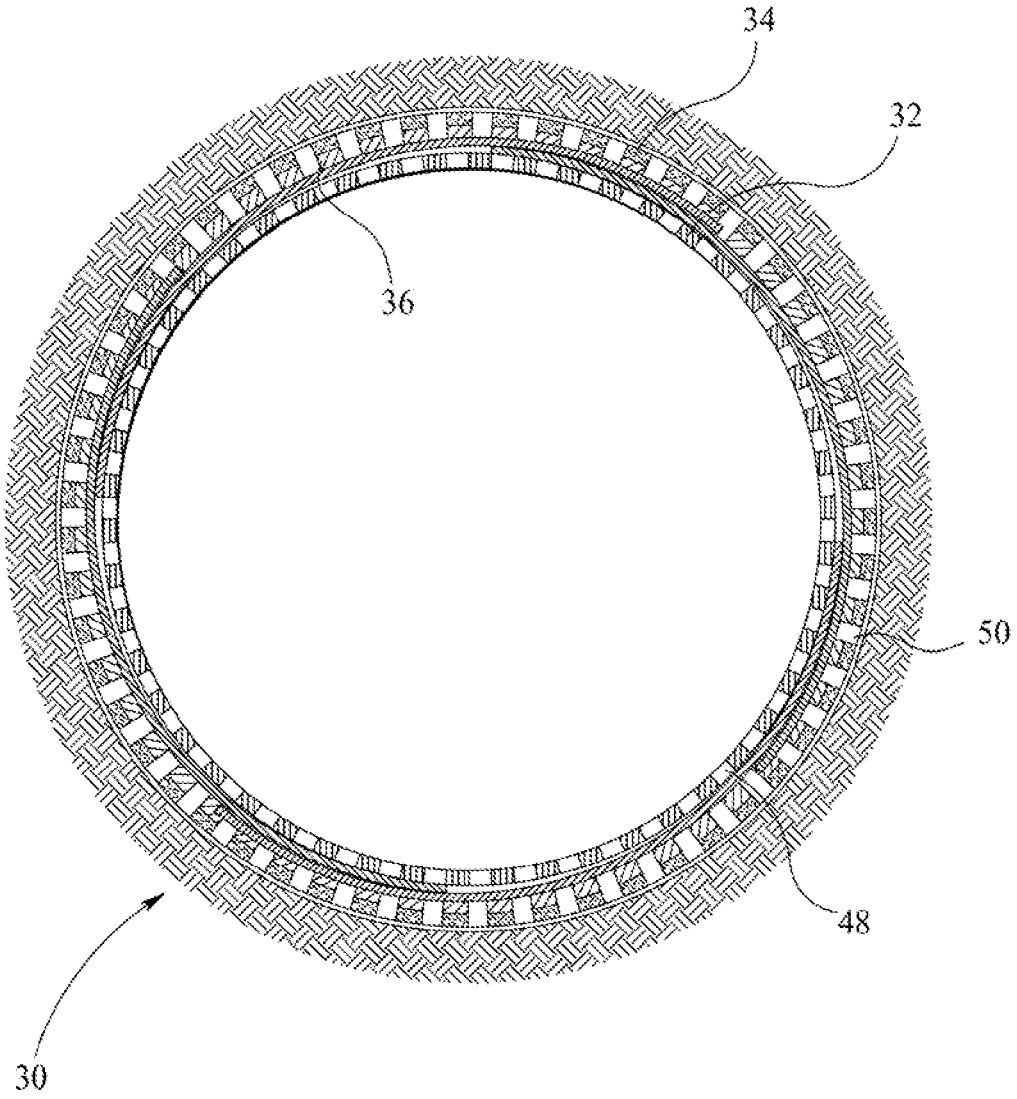
FIG. 3*a* is a cross sectional view of the apparatus of FIG. 3 with the seal member in a second configuration in accordance to one embodiment of the invention.

As shown in FIGS. 2 and 3, the carrier tube 32 is radially expanded by an expansion tool (not shown). Expansion of the carrier tube 32 also expands the shroud 34 such that the shroud 32 is in substantially full compliance with the wellbore wall. The shroud also comprises a plurality of longitudinally extending slots 50. While circular perforations may be used, it has been found that the used of slotted tubulars facilitates substantially full compliance of the shroud 34 with the borehole wall, this being particularly advantageous in a rugose wellbore as may be found in a horizontal well.

Expansion of the carrier tube 32 also results in expansion of the filter screen 42. As noted above, the degree of overlap between the filter sheets 44*a*, 44*b*, 44*c*, and 44*d* is sufficient to permit an overlapping sheet arrangement to be retained post expansion.

In order to prevent damage to the relatively fragile filter sheets 44*a*, 44*b*, 44*c*, and 44*d* in the downhole environment, and to facilitate relative circumferential movement of the filter sheets 44*a*, 44*b*, 44*c*, and 44*d* relative to each other and relative to the shroud 34, a low friction coating, for example Polytetrafluoroethylene (PTFE), may be applied to the filter sheets 44*a*, 44*b*, 44*c*, and 44*d*.

The pore size of the filter sheets 44*a*, 44*b*, 44*c*, and 44*d* will typically remain substantially constant post expansion, the pore size having been selected to prevent ingress of particulates, for example sand, from the formation into the carrier tube 32.

In use, where the carrier tube 32 is radially expanded, the free edges of the filter sheets 44*a*, 44*b*, 44*c*, and 44*d* slide over each other to maintain the filter integrity of the screen 42. On expansion of the carrier tube 32, a radial retaining force is generated in the shroud 34 which is applied to the filter sheets 44*a*, 44*b*, 44*c*, and 44*d* to further maintain the integrity of the screen 42.

The carrier tube 32 and shroud 34 may be constructed from low carbon stainless steel, for example grade 316L, which is substantially inert to wellbore fluids, though other suitable materials may be used.

The shroud 34 is constructed from a metal sheet, the seal member 36 being vulcanised onto the surface of the sheet. Slots 50 are created in both the shroud 34 and seal member 36 by a punching process. This advantageously permits the slots 50 in the shroud 34 to be substantially aligned with the slots in the seal member 36 and obviates the requirement to align the shroud 34 and seal member 36 independently. The sheet is then formed into a tubular construction with opposing edges welded together to form the shroud 34. This forming step permits the operator to choose whether to locate the seal member 36 on the interior (as shown in FIGS. 2 and 3) or exterior (as shown in FIGS. 4, 5 and 6*a* to 6*c*) of the shroud 34, as required.

In use, the apparatus is located downhole and then expanded to permit production fluid 16 to be extracted from the well 20. In response to contact with water in the formation 14, the sealing member 36 is adapted to swell and expand to block and seal the apertures 50 of the shroud 34 at a given location and to prevent water production from the well 20 at that location.

As noted above in respect of horizontal or deviated wells, water coning will initially tend to occur at the heel of the well 20. The sealing member 36, when exposed to water, will swell and restrict water ingress while permitting oil to flow from neighbouring portions of the well 20 which are not exposed. The restriction is applied only to the water producing region and is limited to that location for as long as the water cut exceeds the desired level. This will advantageously assist in increasing the recovery efficiency of the well 20.

It will be recognised that where a restriction has been imposed, water may then be drawn to an adjacent, open section of tubing and water production may again result. An apparatus 30 according to the present invention will then isolate this section of tubing, while the point at which water production was first experienced, in the absence of water, will again permit ingress of production fluid. The apparatus 30 thus permits autonomous and reactive sealing without the requirement for intervention from surface, the restriction being applied at the required location and being adapted to automatically adjust over the life of the well 20.

The apparatus 30 can restrict flow from any water zone, and thus no pre-planning is required as to when to run the apparatus 30 downhole. This is particularly advantageous where unexpected water producing zones are encountered.

The apparatus will thus slow the ingress of water into the heel of a horizontal well. In addition, the apparatus will also assist in controlling water production along the length of the well in multizone reservoirs or, alternatively, in reservoirs with heterogeneous formations where a highly permeable layer or fracture is communicating to an underlying aquifer. The apparatus will enhance oil recovery, improve sweep efficiency and extend well life by allowing more oil to be produced for longer at a lower water cut. This is especially true in heavier oil applications, where high water mobility may cut oil production dramatically. The apparatus has the additional economic benefit of reducing the cost of water handling that would otherwise be required.

Those of skill in the art will further recognise that the illustrated apparatus is merely exemplary of the present invention, and that the same objectives may be achieved by using a variety of different configurations.

Figure 4:
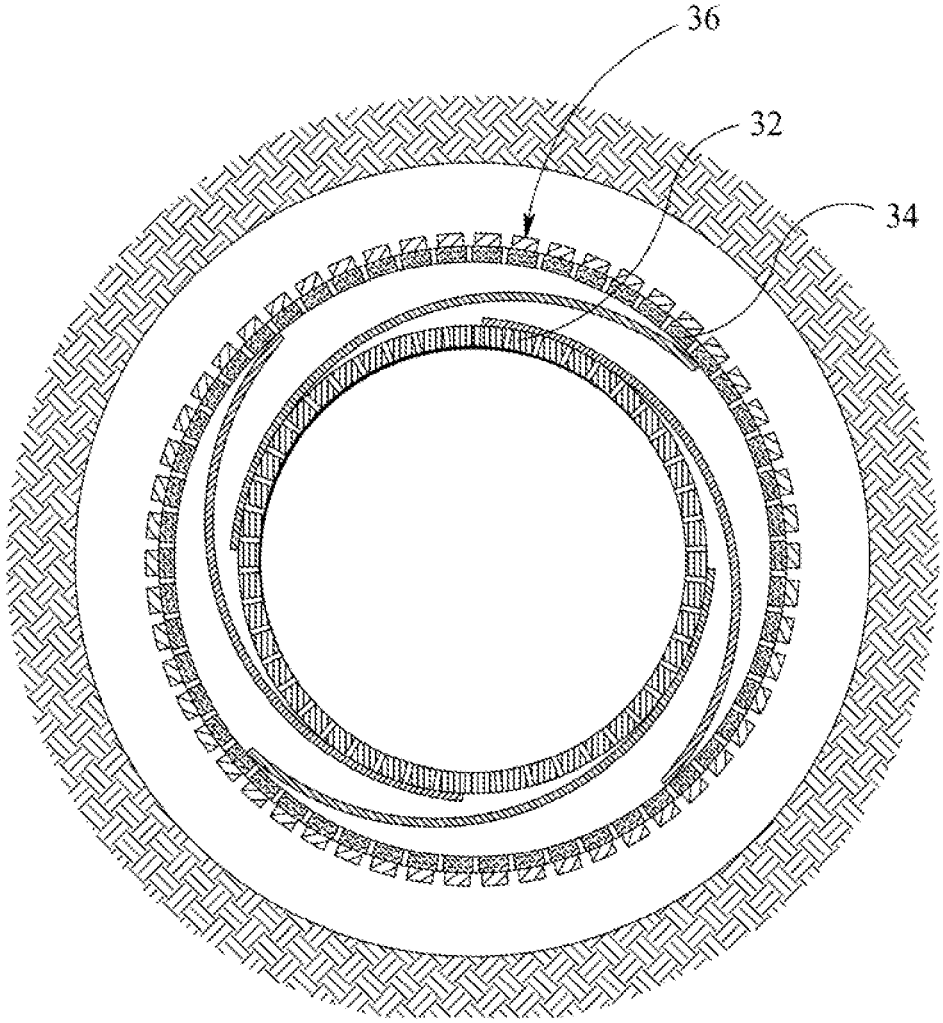
FIG. 4 is a cross sectional view of an apparatus for isolating at least a portion of a tubular in accordance with a second embodiment of the present invention, shown in an unexpanded configuration.
Figure 5:
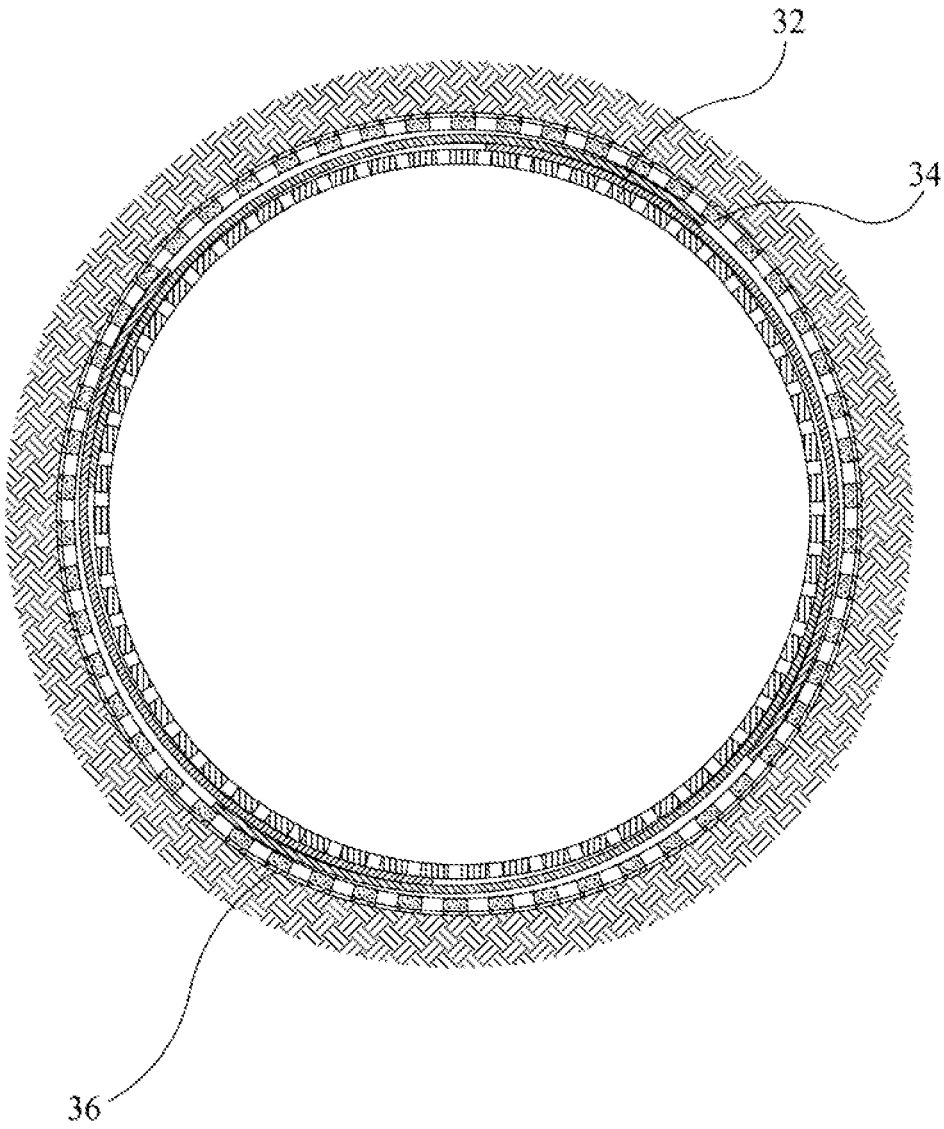
FIG. 5 is a cross sectional view of the apparatus of FIG. 4, shown in an expanded configuration.

For example, an alternative embodiment of the present invention is shown in FIGS. 4 and 5 of the drawings. The second embodiment differs from the first embodiment in that the seal member is bonded to an exterior surface of the shroud. In this embodiment, the apparatus also comprises an alignment tool in the form of a centraliser tool (not shown). A centraliser tool assists in placing the apparatus downhole while protecting the seal member from damage.

Figure 6A:
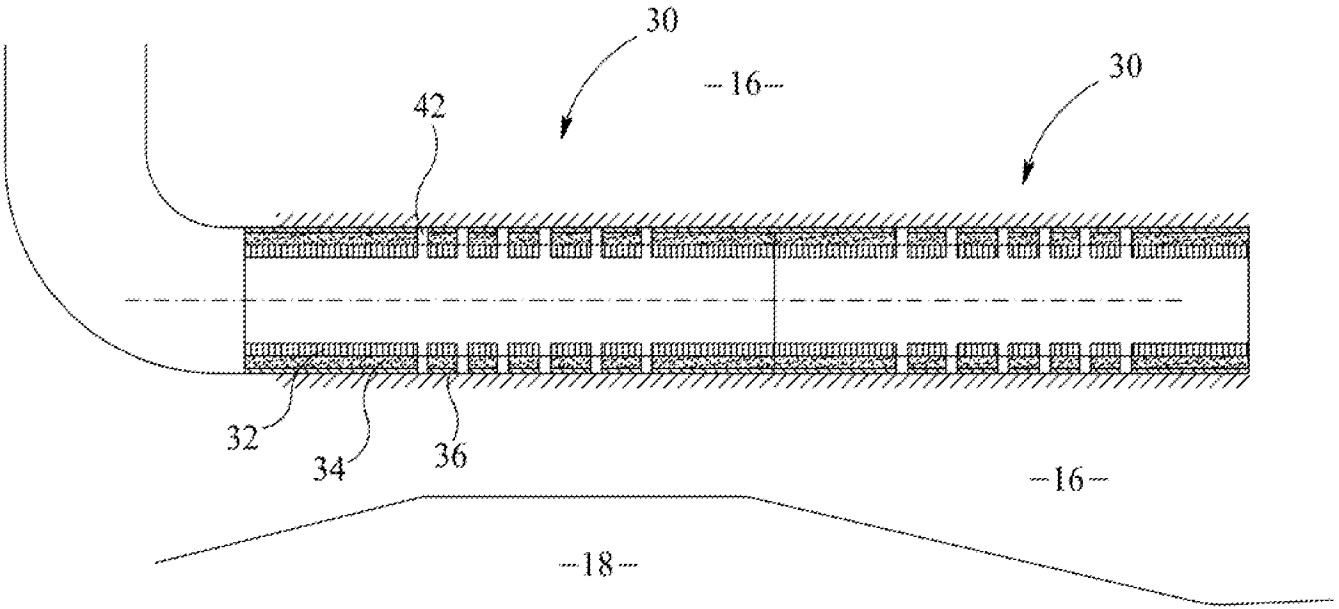
FIGS. 6*a* to 6*c* are diagrammatic views of an apparatus according to the second embodiment of the present invention shown in a horizontal wellbore.
Figure 6B:
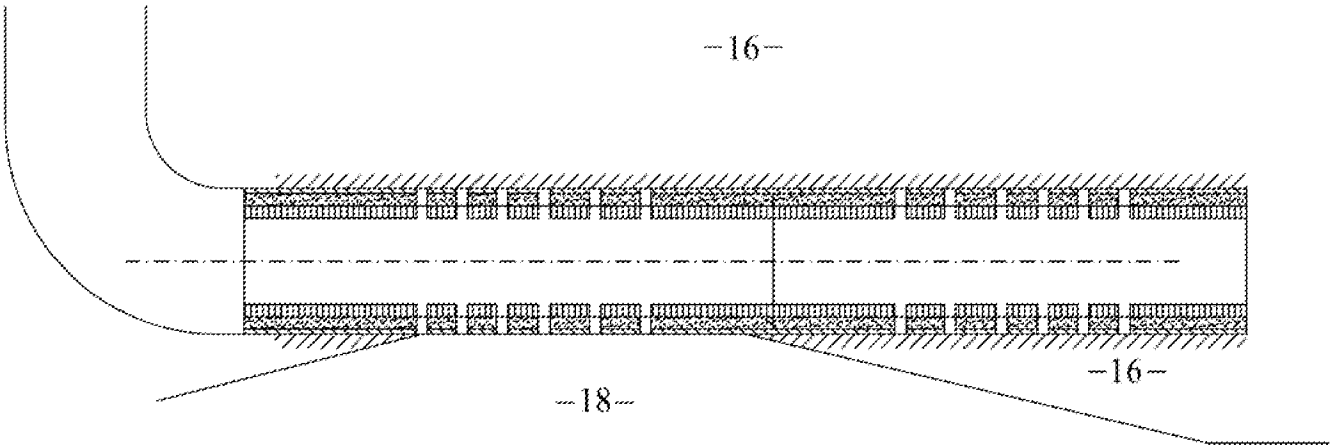
Figure 6C:
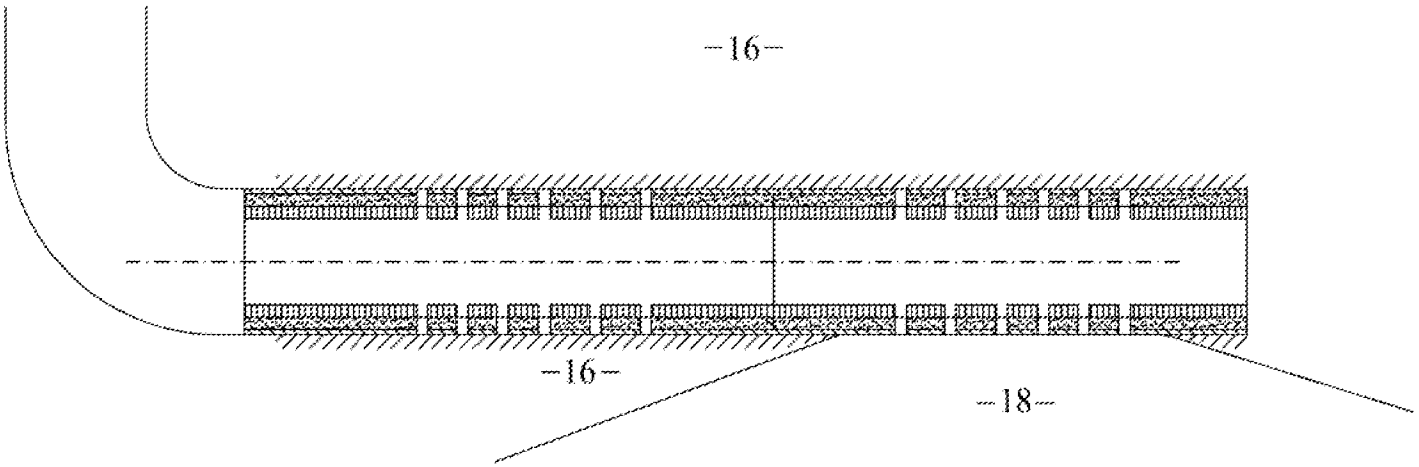

Referring now to FIGS. 6*a* to 6*c* of the drawings, there is shown a diagrammatic view of the apparatus of FIGS. 4 and 5 shown in a horizontal wellbore. It will of course be recognised that the apparatus of FIGS. 2 and 3 could also be used.

FIG. 6*a* shows the apparatus prior to encountering water. FIG. 6*b* shows the apparatus after water has been encountered at the heel of the wellbore. FIG. 6*c* shows the apparatus where water ingress has migrated. The position of the first water ingress is shown in dotted line. Thus, it will be recognised that where water is encountered, the apparatus will seal off that section while permitting those sections not exposed to water to continue or re-start transfer of fluid.

Though the apparatus has been described as using slotted tubulars, other configurations of apertures may be used. For example perforated (generally circular apertures) tubing may be used, though it is understood that the use of perforated tubing limits the compliance that may be achieved. Typically, when expanding perforated tubulars, cone expander tools are preferred which, for relatively long sections of tubing string require significant force to drive the expander through the tubing. It will be readily understood that the application of a high force will become increasingly difficult where the wellbore deviates from the vertical.

Though the present embodiment is described in connection with a sand screen, in particular an expandable sand screen, it is within the scope of the invention that the assembly will be used in combination with any suitable tubular or the like.

It will be recognised that more than one tubular may be coupled together to form a tubing string. The properties of the seal member may be selected such that the threshold at which swelling of the seal member is initiated may be different. More than one seal member may be provided on the or each tubular and each seal member may be selected to react to a different selected reactant.

The invention claimed is:

1. A method for producing an apparatus for isolating at least a portion of a tubular, the method comprising:

providing a tubular member comprising at least one aperture in a wall of the tubular member;

providing a second member comprising a structural layer and a seal layer;

simultaneously creating at least one aperture in the structural layer and the seal layer;

locating the second member around the tubular member; and disposing a filter screen layer between the first tubular and the second member.

2. The method of claim 1, wherein the second member is initially provided in planar form.

3. The method as claimed in claim 2, further comprising coupling a first edge of the structural layer to a second, opposite edge of the structural layer to create the second member.

4. The method as claimed in claim 3, further comprising welding the first and second edges together to form the second member.

5. The method as claimed in claim 1, further comprising forming the second member such that the seal layer is provided on an exterior surface of the second member.

6. The method as claimed in claim 1, further comprising forming the second member such that the seal layer is provided on an interior surface of the second member.

7. The method as claimed in claim 1, further comprising forming the at least one aperture in the structural layer and the seal layer by perforating the structural layer and seal layer simultaneously.

8. The method as claimed in claim 1, further comprising forming the at least one aperture in the structural layer and the seal layer by punching the structural layer and seal layer simultaneously.

9. The method as claimed in claim 1, wherein the at least one aperture in the structural layer and the seal layer defines an elongate longitudinal slot.

10. The method as claimed in claim 1, wherein the at least one aperture created in the seal layer and the structural layer are substantially aligned.

11. The method as claimed in claim 1, wherein the filter screen layer is coupled to the tubular member.

12. The method as claimed in claim 1, wherein the filter screen layer comprises a plurality of filter sheets coupled to the tubular member.

13. The method as claimed in claim 12, further comprising coupling the filter sheets in an overlapping configuration.

14. The method as claimed in claim 12, further comprising coupling the filter sheets to the tubular member such that on expansion of the tubular member, the filter sheets remain overlapped.

15. The method of claim 1, wherein the seal layer comprises an elastomer.

16. The method of claim 15, wherein the elastomer comprises a swelling elastomer.

17. The method of claim 1, wherein the filter screen layer is in contact with the seal layer.

18. The method of claim 1, wherein the filter screen layer comprises a plurality of filter screens.

19. The method of claim 18, wherein at least a portion of each filter screen overlaps an adjacent filter screen.

20. The method of claim 19, wherein the filter screens are configured to slide with respect to each other.

21. The method of claim 1, wherein an annular void exists between at least a portion of the second member and the tubular member.

22. The method of claim 17, wherein the filter screen layer is disposed in the annular void.

23. A method of manufacturing an apparatus for isolating a portion of a wellbore, the method comprising:

providing a first tubular member having a structural layer and a seal layer;

creating at least one aperture in the structural layer and the seal layer simultaneously;

locating the first tubular member around a second tubular member; and disposing a filter screen layer between the first tubular member and the second tubular member.

24. The method of claim 23, wherein the at least one aperture is created by perforating the structural layer and seal layer.

25. The method of claim 12, wherein the at least one aperture is created by punching the structural layer and seal layer.

26. The method of claim 23, wherein the second tubular includes at least one aperture in a wall of the second tubular member.

27. The method of claim 23, wherein the seal layer comprises an elastomer.

28. The method of claim 27, wherein the elastomer comprises a swelling elastomer.

29. A method for producing an apparatus for isolating at least a portion of a tubular, the method comprising:

providing a first tubular having at least one aperture in a wall of the first tubular;

attaching a seal layer to a structural layer to form a second member;

creating at least one aperture in the seal layer and the structural layer simultaneously;

locating the second member around the first tubular; and disposing a filter screen layer between the first tubular and the second member.

30. The method of claim 29, further comprising forming a second tubular using the second member.

* * * * *

UNITED STATES PATENT AND TRADEMARK OFFICE

CERTIFICATE OF CORRECTION

PATENT NO. : 8,863,854 B2
APPLICATION NO. : 13/724849
DATED : October 21, 2014
INVENTOR(S) : Jones et al.

It is certified that error appears in the above-identified patent and that said Letters Patent is hereby corrected as shown below:

In the Claims:

Column 10, Claim 22, Line 66, please delete "17" and insert -- 21 -- therefor;

Column 11, Claim 25, Line 14, please delete "12" and insert -- 23 -- therefor.

Signed and Sealed this
Thirty-first Day of March, 2015

Michelle K. Lee

Michelle K. Lee
*Director of the United States Patent and Trademark Office*